United States Patent [19]

Su

[11] Patent Number: 4,844,277

[45] Date of Patent: Jul. 4, 1989

[54] FOLDING CRATE

[76] Inventor: Kuo K. Su, No. 23, Lane 54, Sec. 2, An Ho Road, Tainan, Taiwan

[21] Appl. No.: 183,628

[22] Filed: Apr. 13, 1988

[51] Int. Cl.[4] ..... B65D 7/24

[52] U.S. Cl. ..... 220/6; 220/DIG. 15

[58] Field of Search ..... 220/6, DIG. 15

[56] References Cited

U.S. PATENT DOCUMENTS

| | | | |
|---|---|---|---|
| 3,005,572 | 10/1961 | Gustafson et al. | 220/DIG. 15 R |
| 3,796,342 | 3/1974 | Sanders et al. | 220/6 |
| 4,775,069 | 10/1988 | Stonier | 220/6 |

*Primary Examiner*—Steven M. Pollard

*Attorney, Agent, or Firm*—Morton J. Rosenberg

[57] ABSTRACT

A folding crate comprising a rectangular upper frame, two end walls, two upper side webs, two lower side webs, and a base panel. The upper side webs are foldable with respect to the upper frame and the lower side webs are foldable with respect to the base panel by forming a plurality of tubular lappings on the connecting face. Each pair of juxtaposed lappings is engaged together by a pin member. Characterized in that a distress sign having divided into two halves is combined with one of the upper and lower side webs in a manner which does not affect the folding of the crate.

2 Claims, 3 Drawing Sheets

FOLDING CRATE

BACKGROUND OF THE INVENTION

The present invention relates generally to folding crates, and more particularly, to a folding crate having a distress sign.

Crates that cannot be folded occupy a larger space for storage even though when not in use. In response to this problem, folding crates of various sizes and shapes have been produced. One of the folding crates has been disclosed in U.S. Pat. No. 4,720,020, as filed by the same applicant as the present invention. U.S. Pat. No. 4,720,020 is, therefore, incorporated herein for reference.

Folding crate has been widely used in many places, owing to its usefulness and functionability. Many people have had one ready in their car trunks. Nevertheless, a distress sign is very often placed in the car trunk.

SUMMARY OF THE INVENTION

It is, therefore, a primary objective of the present invention to provide a folding crate having a distress sign.

Another objective of the present invention is to provide a folding crate which is capable of functioning as a distress sign.

These and other objectives, which will become apparent from a careful reading of the description provided hereinafter, is accomplished by a folding crate comprising a plurality of elements including a rectangular upper frame, two end walls, two upper side webs, two lower side webs, and a base panel, said elements being mutually combinable by means of a plurality of tubular lappings formed on each element with a same number of corresponding notches, characterized in that a distress sign having divided into two halves being combinable with one of the upper and lower side webs in a manner which does not affect the folding of the crate.

DETAILED DESCRIPTION OF THE PREFERRED EMBODIMENT

Figure 1:
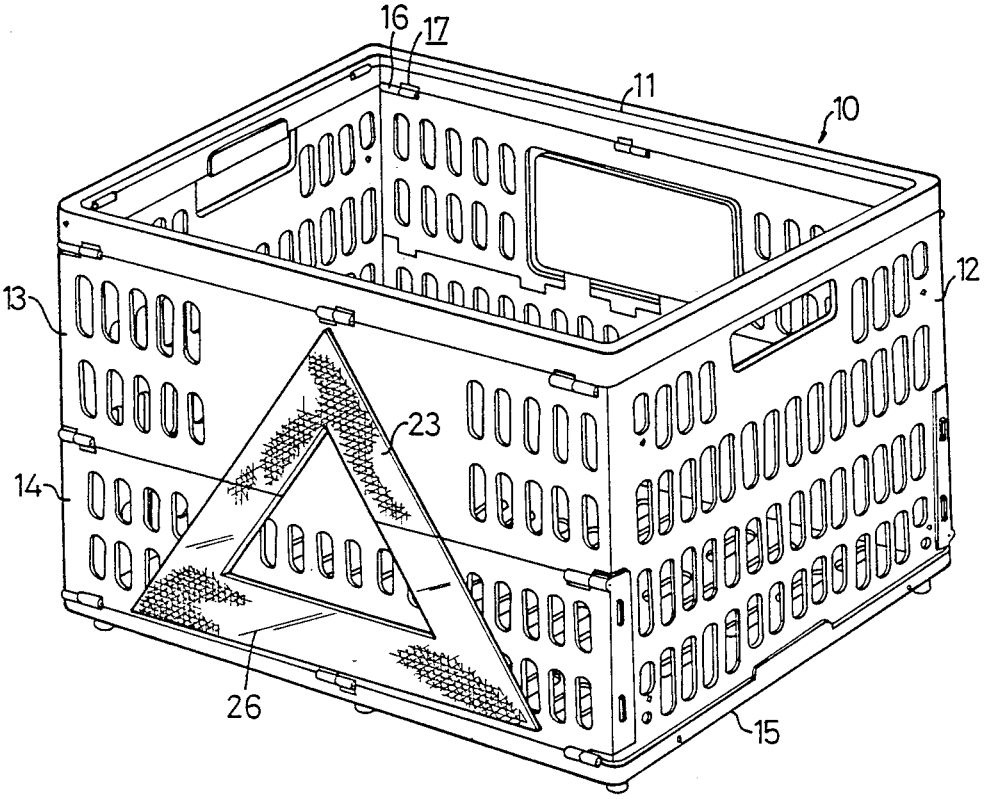
FIG. 1 is a perspective view of a folding crate in accordance with the present invention.

Referring to the drawings and initially to FIG. 1, a folding crate in accordance with the present invention is shown generally by reference numeral 10. It can also be seen that the folding crate 10 has a symmetrical configuration and comprises a substantially rectangular upper frame 11, two transverse end walls 12, two longitudinal upper side webs 13, two longitudinal lower side webs 14, and a base panel 15.

Although not limited thereto, it is preferably that these walls, webs and panel are formed with a plurality of vertically, horizontally aligned, equally spaced holes. A plurality of supports are, preferably, peripherally and detachably mounted on a lower face of said base panel 15 so that a folding crate is stackable on another folding crate.

The rectangular upper frame 11, the two transverse end walls 12, the two upper side webs 13, the two lower side webs 14, and the base panel 15 are combined together, and the upper side webs 13 are foldable with respect to the upper frame 11 and the lower side webs 14 are foldable with respect to the base panel 15. This can be accomplished in any conventional manner. In one embodiment, this is accomplished by forming a plurality of tubular lappings 16 with a same number of notches 17 on the connecting faces of the frame, webs, and panel.

Each of the tubular lappings 16 is retained in each of the corresponding notches 17. The tubular lappings 16 are arranged in a manner such that the tubular lappings 16 of an element is juxtaposed with the tubular lappings 16 of an adjacent element. For example, the upper periphery of the upper side webs 13 is provided with a plurality of tubular lappings 16 which are juxtaposed with a same number of tubular lappings 16 on the lower periphery of the upper frame 11 respectively, and the lower periphery of the upper side webs 13 is provided with a plurality of tubular lappings 16 which are juxtaposed with a same number of tubular lappings 16 formed on the upper side of the lower side webs 14. Each pair of juxtaposed tubular lappings 16 are engaged together by a pin member 18.

Figure 2:
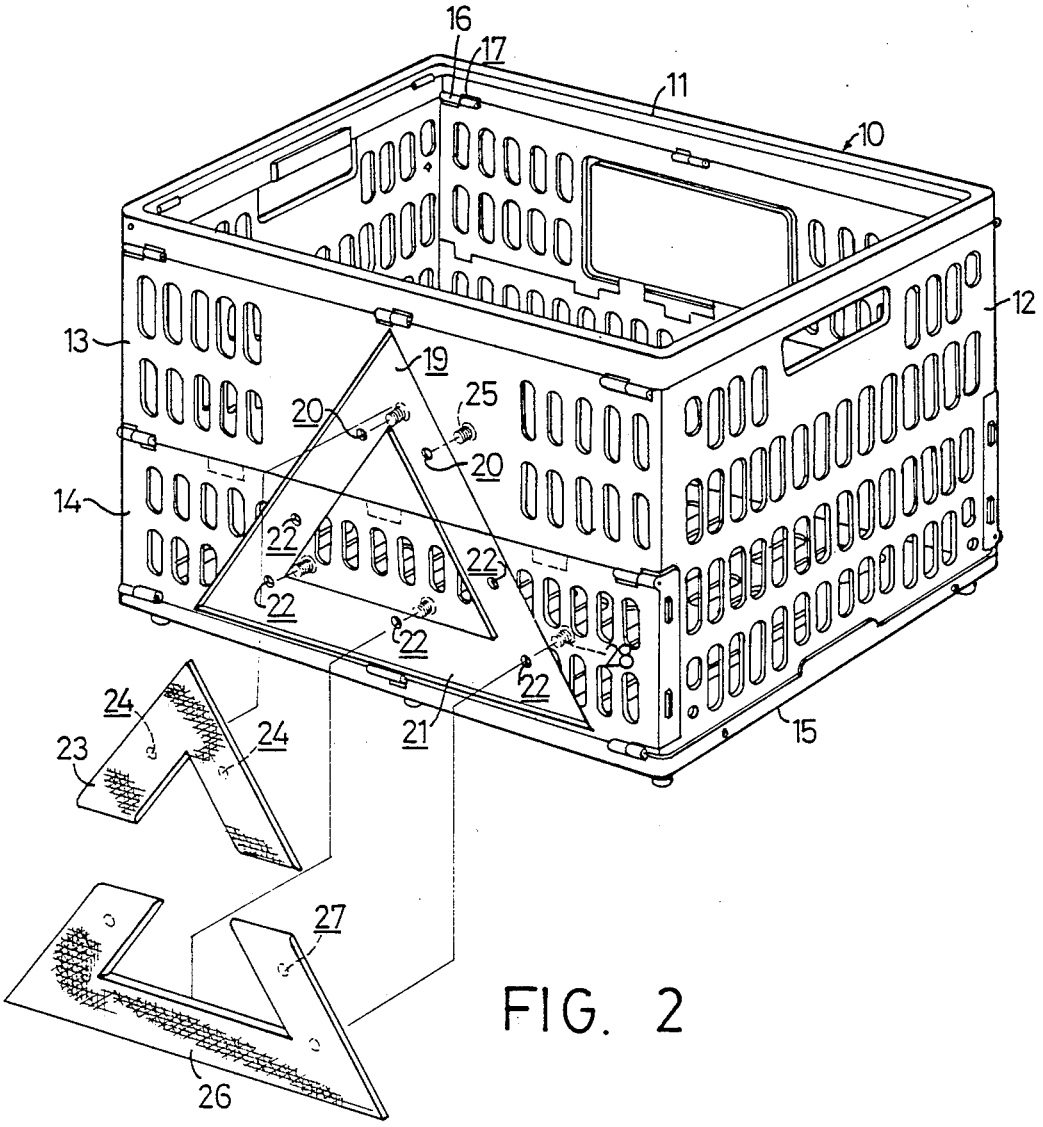
FIG. 2 is an exploded view of the folding crate illustrating the structure thereof.

Referring to FIGS. 1 and 2, one of the upper side webs 13 is formed with a first shallow recess 19 of an inverted V-shaped configuration. The first shallow recess 19 is provided with at least two countersinks 20. The corresponding lower side web 14 is provided with a second shallow recess 21 which forms the shape of a distress sign after combined with the first shallow recess 19 of the upper side web 13. The second shallow recess 21 is provided with a plurality of countersinks 22 at proper locations.

Figure 3:
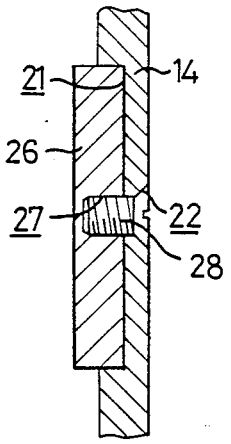
FIG. 3 is a sectional view illustrating the combination of folding crate and distress sign.

Referring to FIGS. 2 and 3, it can be seen that the first shallow recess 19 formed on the upper side web 13 is engagable with an upper half of a distress sign 23 of standard size and shape. Said upper half of the distress sign 23 is provided with two threaded tap holes 24 (shown in dotted lines) at locations corresponding to the locations of the countersinks 20. Two bolts 25 (shown in dotted line) are employed to combine the upper side web 13 with the upper half of the distress sign 23. In substantially the same manner, the lower side web 14 is combined with a lower half of the distress sign 26 which is provided with a same number of threaded tap holes 27 (shown in dotted line) on corresponding locations with respect to the countersinks 22 on the lower side web 14. A same number of bolts 28 (shown in dotted line) are employed to combine the lower side web 14 and the lower half of the distress sign 26. It is preferable that the threaded tap holes 24 and 27 do not penetrate through the distress sign so as to maintain a perfect outlook of the distress sign.

It is preferable that the thickness of the upper half and the lower half of the distress sign 23 and 26, when superposed together, does not exceed the thickness of the hinging junction of the upper and lower side webs 13 and 14. Preferably, the upper half of distress sign 23 and the lower half of the distress sign 26 do not combine in an abutting manner. A slit is remained between the upper half and the lower half of the distress sign 23 and 26 when fabricated on the upper and lower side webs 13 and 14 respectively, so as to facilitate the set up and folding of the crate.

Figure 4:
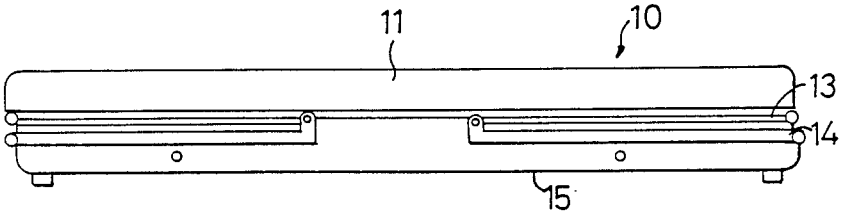
FIG. 4 is a perspective view of the folding crate in its folded state.

With particular reference to FIG. 4, the manner in which the crate 10 is folded will now be described. Firstly, push the end walls 12 inwardly and upwardly, then press the upper and lower side webs 13 and 14 inwardly. Finally, press the whole structure downwardly and thus the whole article collapses down within seconds. To set up the crate 10, simply reverses the above-described sequence. The distress sign causes no effect on the folding of the crate.

While in accordance with the patent statutes, a best mode and preferred embodiment has been presented, the scope of the invention is not limited thereto, but rather by the scope of the invention.

I claim:

1. A folding crate comprising a plurality of elements including a rectangular upper frame, two end walls, two upper side webs, two lower side webs, and a base panel, said elements being mutually combinable by means of a plurality of tubular lappings formed on each said element with a same number of corresponding notches; the improvement comprising:

(a) a first shallow recess of an inverted V-shaped configuration formed on one of said upper side webs for receiving an upper half of a distress sign, said first shallow recess being provided with two countersinks and said upper half of the distress sign being provided with two threaded tap holes at locations corresponding to said countersinks, two bolts being used for combining said upper half of the distress sign to said upper side web;

(b) a second shallow recess formed on the lower side web corresponding to said upper side web for receiving a lower half of a distress sign, said second shallow recess being provided with a plurality of countersinks and said lower half of the distress sign being provided with a same number of threaded tap holes corresponding to said countersinks, a same number of bolts being employed to combine said lower half of the distress sign to said lower side web; and, (c) said upper half and said lower half of the distress sign having a combined thickness not exceeding a thickness of a hinging junction of said upper and lower side webs, thereby allowing said crate to be foldable.

2. A folding crate as set forth in claim 1, wherein said threaded tap holes do not penetrate through the distress sign.

* * * * *